US007331793B2

(12) United States Patent
Hernandez et al.

(10) Patent No.: US 7,331,793 B2
(45) Date of Patent: Feb. 19, 2008

(54) MAGNETIC CONNECTOR

(75) Inventors: Edwin A. Hernandez, Coral Springs, FL (US); James L. Tracy, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/305,780

(22) Filed: Dec. 16, 2005

(65) Prior Publication Data

US 2007/0141860 A1 Jun. 21, 2007

(51) Int. Cl.
*H01R 11/30* (2006.01)

(52) U.S. Cl. ..... 439/38; 439/950

(58) Field of Classification Search ..... 439/38, 439/39, 950
See application file for complete search history.

(56) References Cited

U.S. PATENT DOCUMENTS

| | | | | |
|---|---|---|---|---|
| 3,550,682 | A * | 12/1970 | Fowler | 166/338 |
| 3,786,391 | A * | 1/1974 | Mathauser | 439/39 |
| 3,810,258 | A * | 5/1974 | Mathauser | 439/39 |
| 4,038,625 | A * | 7/1977 | Tompkins et al. | 336/83 |
| 4,112,941 | A | 9/1978 | Larimore | |
| 4,838,797 | A * | 6/1989 | Dodier | 439/38 |
| 4,844,582 | A * | 7/1989 | Giannini | 385/57 |
| 5,385,476 | A * | 1/1995 | Jasper | 439/38 |
| 6,184,651 | B1 | 2/2001 | Fernandez et al. | |
| 6,607,391 | B2 * | 8/2003 | Mendelson et al. | 439/39 |
| 6,727,477 | B1 * | 4/2004 | Li-Chen | 219/494 |
| 6,856,792 | B2 | 2/2005 | Harmon | |
| 7,066,739 | B2 * | 6/2006 | McLeish | 439/39 |
| 2004/0209489 | A1 * | 10/2004 | Clapper | 439/39 |
| 2005/0083316 | A1 | 4/2005 | Brian et al. | |

FOREIGN PATENT DOCUMENTS

| | | |
|---|---|---|
| DE | 2516011 A * | 10/1976 |
| GB | 2390259 | 12/2003 |
| WO | WO 2004 016896 | 2/2004 |

OTHER PUBLICATIONS

Electronic Design "GMSK-Modulated Magnetic Link Spurs PANs", Ashok Bindra, Jul. 23, 2001. Penton Media, Inc. http://www.elecdesign.com/Articles/Index/cfm?AD&ArticleID=3813, Site last visited Dec. 16, 2005.

RFDESIGN "Magnetic Induction: A Low-Power Wireless Alternative", Chris Bunszel, Nov. 1, 2001. Primedia, Inc. http://www.rfdesign.com/mag/radio_magnetic_Induction_lowpower/Index.html. Site last visited Dec. 16, 2005.

* cited by examiner

*Primary Examiner*—Thanh-Tam Le

(57) ABSTRACT

A connector (30) can include a housing (32), a plurality of magnets (14) within the housing used for data transfer and at least one alignment magnet (16 or 18) within the housing used for proper alignment and polarity. The connector can also include at least one magnetic induction circuit (52) coupled to at least one of the plurality of magnets. The plurality of magnets can include a plurality of inductor elements or micro-metric inductor elements. The magnetic induction circuit can be a magnetic induction circuit using Gaussian Minimum Shift Keying modulation. A connector (64) can further include an inductive coil (67) operating at a lower frequency than the at least one magnetic induction circuit. The inductive coil can enable contact less energy transfer from the connector to an energy storage device (69) operatively coupled to an electronic product (62).

18 Claims, 4 Drawing Sheets

MAGNETIC CONNECTOR

FIELD

This invention relates generally to connectors, and more particularly to connectors using magnets for coupling an accessory to a host device.

BACKGROUND

Mobile devices such as cellular phones typically include a bottom connector that is used for both data programming and battery charging. Some connectors also include a cover for the connector or port to prevent water or dust intrusion and to otherwise protect the connector or port from the environment. Such connectors also include a mechanical attachment scheme that can include latches or hooks that can eventually fail over time.

SUMMARY

Embodiments in accordance with the present invention can provide magnetic contacts or inductive contacts instead of mechanical contacts.

In a first embodiment of the present invention, a connector can include a housing, a plurality of magnets within the housing used for data transfer and at least one alignment magnet (which can be one or more permanent magnets) within the housing used for proper alignment and polarity. The plurality of magnets or the at least one alignment magnet can be used for power transfer. The connector can further include at least one magnetic induction circuit coupled to at least one of the plurality of magnets. The plurality of magnets can include a plurality of inductor elements or micro-metric inductor elements. The magnetic induction circuit can be a magnetic induction circuit using Gaussian Minimum Shift Keying modulation. The connector can further include an inductive coil operating at a lower frequency than the at least one magnetic induction circuit. The inductive coil can enable contact less energy transfer from the connector to an energy storage device (such as a battery) operatively coupled to an electronic product. The plurality of magnets can be completely covered by the housing or they can have a portion that remains partially externally exposed while remaining within the housing. The connector can use a sensor for detecting a coupling of the at least one alignment magnet with a corresponding magnet in an electronic product that couples with the connector. The connector can also include a metal core (such as a ferrite core) attracted to an electromagnet activated by the coupling of the at least one alignment magnet with the corresponding magnet in the electronic product.

In a second embodiment of the present invention, a magnetic connector system can include a connector having a housing, a plurality of magnets within the housing used for data transfer and at least one alignment magnet (such as at least one permanent magnet) within the housing used for proper alignment and polarity. The plurality of magnets or the at least one alignment magnet can be used for power transfer. The magnetic connector system can further include at least one magnetic induction circuit coupled to at least one of the plurality of magnets. The plurality of magnets can include a plurality of inductor elements or a plurality of micro-metric inductor elements and the induction circuit can use Gaussian Minimum Shift Keying modulation for example. The connector can further include an inductive coil operating at a lower frequency than the at least one magnetic induction circuit to enable contact less energy transfer from the connector to an energy storage device (such as a battery) operatively coupled to an electronic product. As discussed above, the plurality of magnets can be completely covered by the housing or can have portions partially externally exposed while remaining within the housing enabling either a direct electronic coupling or a magnetic inductive coupling between the plurality of magnets and a corresponding plurality of magnets in an electronic product that mates with the connector. The connector can also use a sensor in an electronic product that mates with the connector for detecting a coupling of the at least one alignment magnet with a corresponding magnet in the electronic product. The connector can further include a metal core (such as a ferrite core) attracted to an electromagnet activated by the coupling of the at least one alignment magnet with the corresponding magnet in the electronic product. The system can further include an electronic product having a port with a plurality of corresponding magnetic elements that communicate either inductively or electrically with the plurality of magnets in the connector.

In a third embodiment of the present invention, an electronic product (such as a cellular phone, a smart phone, a video camera, a digital camera, a personal digital assistant, or a laptop computer) can include a data communication and power charging port within a housing, a plurality of magnets within the housing used for data transfer and at least one alignment magnet within the housing used for proper alignment and polarity. The plurality of magnets or the at least one alignment magnet can be used for power transfer. The electronic product can further include at least one magnetic induction circuit coupled to at least one of the plurality of magnets. The plurality of magnets can transfer data with a plurality of magnets in a connector as described above.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

The terms "program," "software application," and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

Other embodiments, when configured in accordance with the inventive arrangements disclosed herein, can include a system for performing and a machine readable storage for causing a machine to perform the various processes and methods disclosed herein.

DETAILED DESCRIPTION OF THE DRAWINGS

Figure 1:
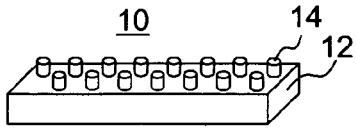
FIG. 1 is an illustration of a header having a plurality of magnets used for a connector assembly in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

Figure 2:
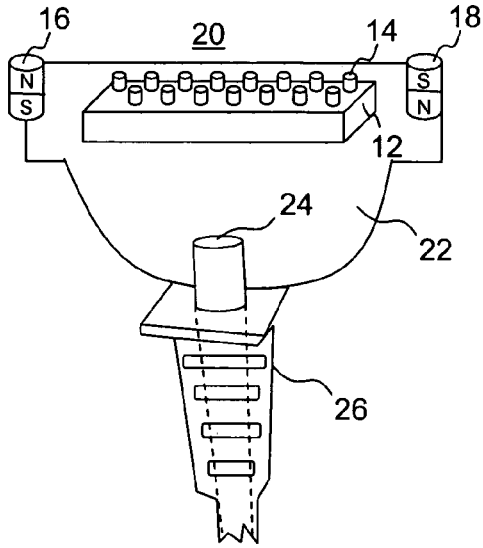
FIG. 2 is an internal illustration of an internal view of a connector assembly in accordance with an embodiment of the present invention.
Figure 3:
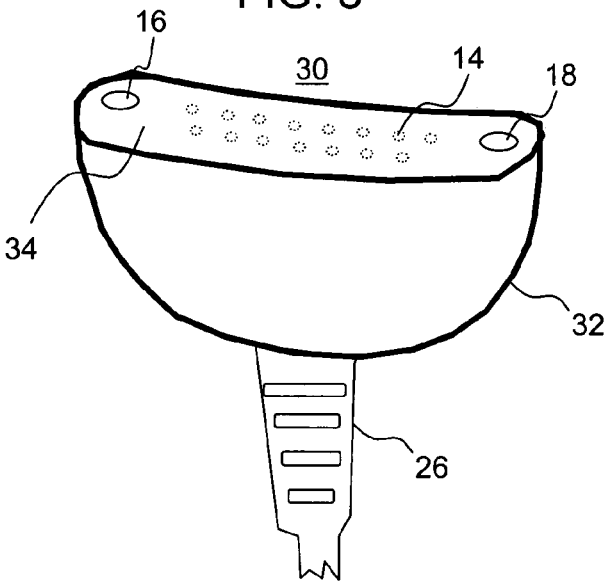
FIG. 3 is a perspective view of the connector or connector assembly in accordance with an embodiment of the present invention.

Referring to FIGS. 1-3, illustrations of how a connector or connector assembly 30 is arranged and constructed is shown. A magnet/header assembly 10 as illustrated in FIG. 1 includes a plurality of magnets 14 positioned into a header 12 similar to conventional electrical contacts positioned into a header. The magnets 14 can be spaced appropriately to prohibit inter-play between their own magnetic fields. Referring to FIG. 2, the magnet/header assembly 10 can be mounted onto a printed circuit board (PCB) 22 along with two additional magnets 16 and 18 serving as alignment magnets to form a connector assembly 20. The magnets 16 and 18 can be permanent magnets, but can optionally or alternatively be electromagnets that are mounted on the outer ends of the connector used for alignment and engagement to a host product. The assembly can further include a power cord 24 and a corded strain relief 26 typically found in many AC or DC adapters. The circuitry on the PCB 22 can include electronic circuitry found on any typical standard accessory products, such as chargers, audio adapters or other data exchangers. Although the connector assembly 30 in FIG.3 is illustrated in a particular arrangement or configuration, it should be well understood to those ordinarily skilled in the art that the connector assembly 30 can be embodied in a wide variety of configurations that have for example different connector shapes or different ordering or shapes in terms of the plurality of magnets 14 or the alignment magnets.

Referring to FIG. 3, a final assembly of a connector or connector assembly 30 can include a housing 32 over the assembly 20 of FIG. 2. The finally assembly can have the plurality of magnets 14 and the alignment magnets 16 and 18 exposed to allow direct-electrical contact with corresponding contacts on the host product if desired. Although the magnets 14, 16, and 18 are illustrated as partially exposed, all or some of these magnets can also be completely covered by a top housing portion 34 so that an environmentally sealed connector is provided. In an arrangement where the header-mounted small conductor magnets 14 are not exposed, only the respective magnetic fields can be present enabling a smooth sealed surface. In such an instance, magnetic induction can be used to transfer energy and/or data as desired. The connector 30 can also include circuitry to trigger or switch an electromagnet permanent-bond as will be further discussed below.

Figure 4:
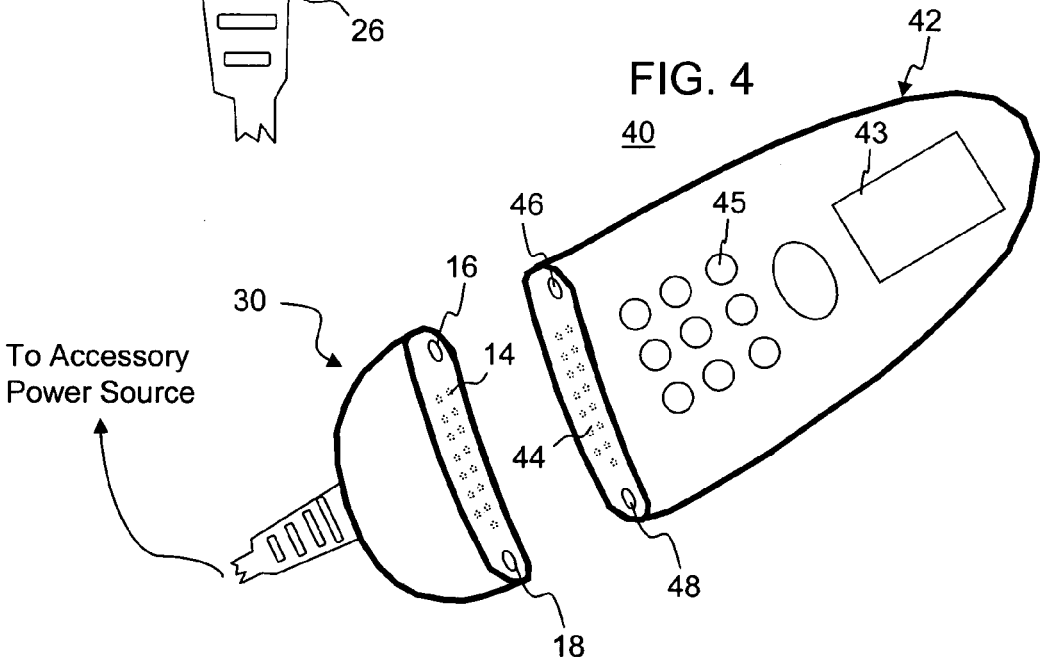
FIG. 4 is a perspective view of the connector FIG. 3 coupling to a corresponding port on a communication product in accordance with an embodiment of the present invention.

Referring to FIG. 4, a magnetic connector system 40 can include the connector 30 of FIG. 3 and a host electronic device 42 such as a radio, cellular phone, video camera, digital camera, lap top computer, or personal digital assistant for example. The connector 30 can include the alignment magnets 16 and 18 as well as the magnets 14 that can be used for data transfer. The host device 42 can likewise have a corresponding port or connector having alignment magnets 46 and 48 as well as the magnets 44 that can mate with the magnets 14 either directly or inductively. Of course, the host device can optionally include other components such as a display 43, keypads 45 and embedded software for appropriately operating as a host device.

Figure 5:
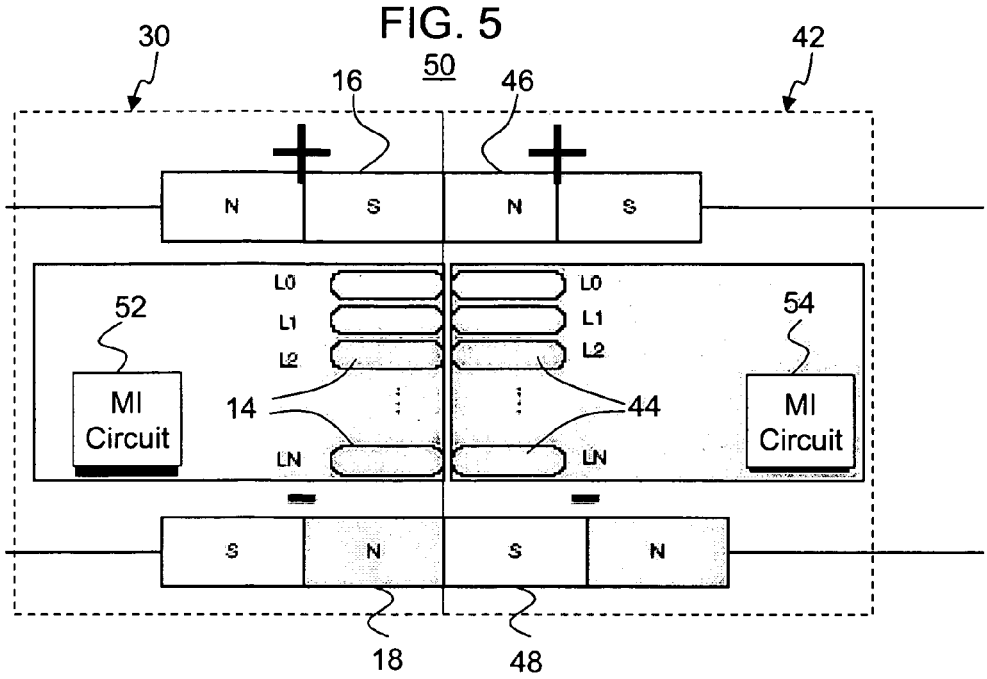
FIG. 5 is a block diagram of a magnetic connector system in accordance with an embodiment of the present invention.

Referring to FIG. 5, a circuit 50 corresponding to the magnetic connector system 40 illustrated in FIG. 4 is shown. In a simple form, the connector 30 can include a plurality of electromagnets 14 as well as permanent magnets 16 and 18 having north (N) and south (S) poles as illustrated. The connector 30 can further include a magnetic inductance circuit 52. Similarly, the host device 42 can include a plurality of electro-magnets 44 as well as permanent magnets 46 and 48 having north (N) and south (S) poles as illustrated that would align and mate with respective magnets 16 and 18 of the connector 30. The host device 42 can further include a magnetic inductance circuit 54.

The plurality of magnets 14 or 44 (L0, L1, L2 . . . ) can be micro-metric inductors which can be separated at a distance of several millimeters (up to 100), however due to the proximity used by bottom connectors as contemplated herein, power can be minimized to reduce possibilities for eavesdropping. The magnetic Inductance circuits 52 and 54 can use GMSK (Gaussian Minimum Shift Keying) modulation that can multiplex the signals coming from N coils representing N elements in the bottom connector. RS-232, EMU, and many other connectors can be magnetically coupled and transfer data with minimum effort using the techniques herein. The connector 30 can match any RS-232 interfaces if desired. Similarly, the N/S magnets 16, 46, 18, and 48 provide the proper polarity for a bottom connector. Also note that electromagnetic induction is a great alternative for low-power over RF at 2.4 Ghz (Bluetooth, WiFi, WiMax) frequencies.

Figure 6:
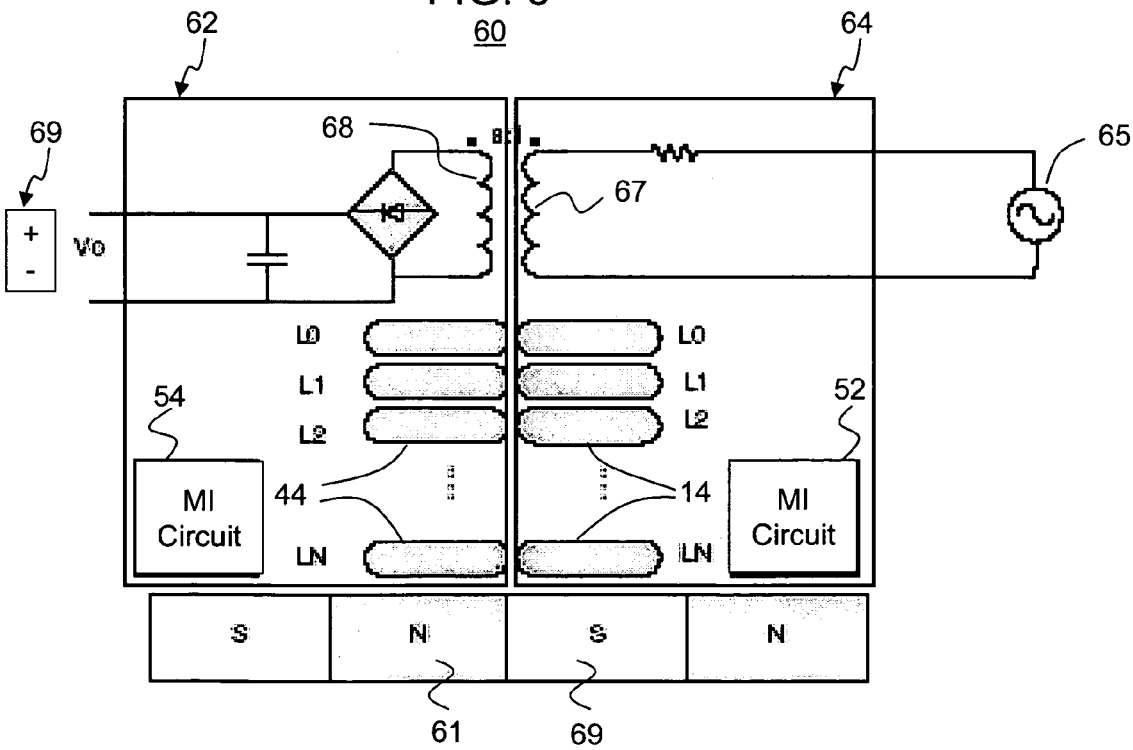
FIG. 6 is a block diagram of another magnetic connector system in accordance with an embodiment of the present invention

Referring to FIG. 6, a circuit 60 similar to the circuit 50 of FIG. 5 is illustrated. Whereas energy can be transferred directly and electrically in the circuit 50 via the magnets 16, 46, 18 and 48, the circuit 60 instead can transfer energy without direct contact or inductively. In this embodiment, the circuit 60 can include a connector 64 having the plurality of electromagnets 14 and an optional alignment magnet 69. The connector 64 can further include the magnetic inductance circuit 52. Likewise, a host device 62 can include the plurality of electromagnets 44 as well as an optional alignment magnet 61 for alignment with magnet 69. The host device 62 can further include the magnetic inductance circuit 54. The connector 64 can achieve contact less energy transfer by coupling a current or power source 65 to a inductor or coil 67. The coil 67 can be larger and operate at a much lower frequency than the coils or inductors used for the electromagnets 14 or 44. The current through coil or inductor 67 can induce current in a corresponding coil or inductor 68 in the host device 68 to power the host device 68 and/or charge a battery 69. As will be illustrated with reference to FIG. 7, the circuitry can be arranged to obviate the use of the magnets 61 and 69 for purposes of holding the connector 62 and host device 64.

Figure 7:
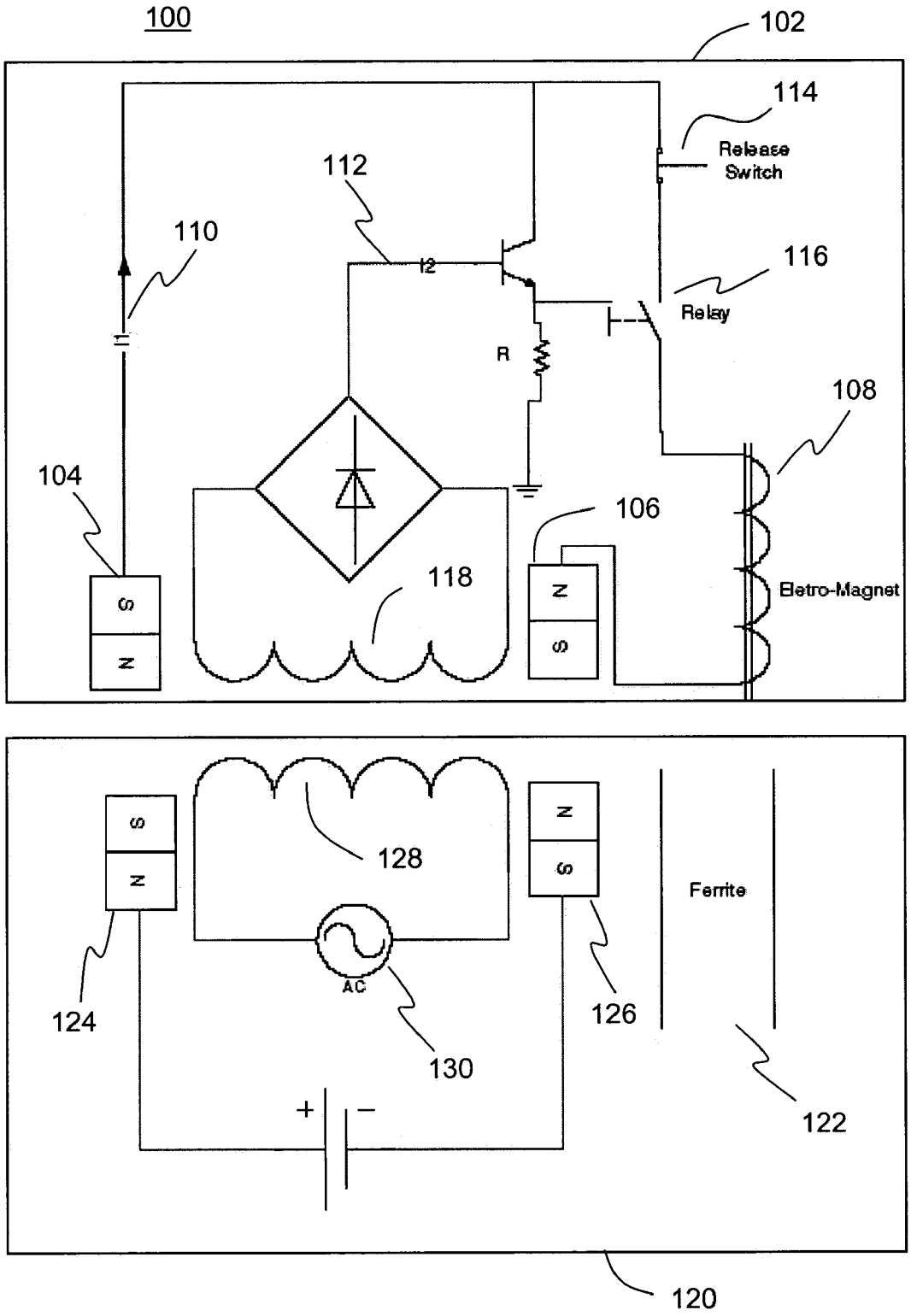
FIG. 7 is a circuit block diagram of a lock-in mechanism used with the connector in accordance with an embodiment of the present invention.

Referring to FIG. 7, another magnetic connector system 100 is illustrated including a connector 120 and a host device 102. A lock-in mechanism in the magnetic connector system 100 is activated by magnetic induction. The connector 120 can include magnets 124 and 126, a current source 130, an inductor or coil 128, and a metal core 122 such as a ferrite core. The host device 102 can include magnets 104 and 106 for mating with magnets 124 and 126, an inductor or coil 118, an electro-magnet 108 and other circuitry used for switching. As illustrated, a magnetic sensor or the inductor 118 interacts with the transistor. At an initial stage, a current (l1) 110 is not present yet, but a current (l2) 112 is generated. However, the transistor is unable to activate the relay element 116 until the N/S poles of the magnets (104, 106, 124, and 126) are aligned. Once the magnets make contact, the current 110 (l1) is no longer zero and, the relay 116 is then activated. Then, the same current drawn for charging a battery is also used to activate the electromagnet(s) 108. The connector 120 can use the metal or ferrite core 122 to cause an attraction to an electromagnetic force produced by the electromagnet 108. A release switch 114 in the host device can simply open the circuit for the electromagnet and enable the release of the connector 120. The release of the connector 120 can then be easy since only permanent magnets hold the connector to the host device 102.

Figure 8:
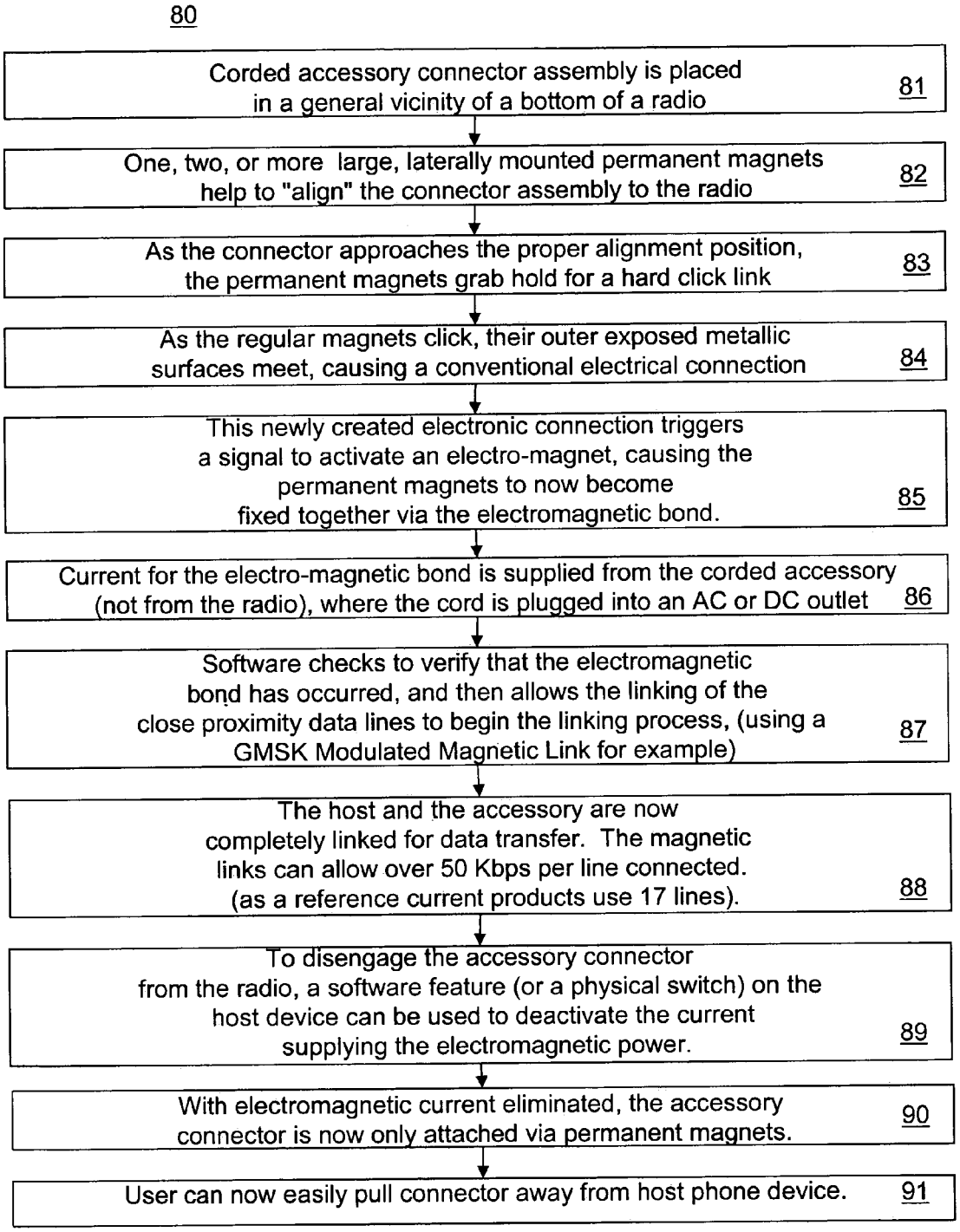
FIG. 8 is a flow chart illustrating a method of operation of the connector system of FIG. 4 or FIG. 5 in accordance with an embodiment of the present invention.

Referring to FIG. 8, a flow chart illustrating a method 80 of operation of a magnetic bottom connector system for a radio is shown. At step 81, a corded accessory connector assembly can be placed in a general vicinity of a bottom portion of a radio. One, two or more laterally mounted permanent magnets can help to "align" the connector assembly to the radio at step 82. As the connector approaches the proper alignment position, the permanent magnets can grab hold for a hard click link at step 83. As the permanent magnets click, their outer exposed metallic surfaces meet, causing an electrical connection at step 84.

At step 85, this newly created electronic connection triggers a signal to activate an electro-magnet, causing the two outer alignment magnets to now become fixed together (with a greater bond than just using the attraction forces of the permanent magnets alone) via an electromagnetic bond. A current used for the electromagnetic bond can be supplied from a corded accessory (not from the radio) at step 86, where the cord is plugged into an AC or DC outlet. Note, other alternatives within contemplation of the claims herein can use current from the radio or host device itself. At step 87, software within the host device or radio can verify that the electromagnetic bond has occurred, and then allows the linking of the close proximity data lines to begin the linking process. The data link can use a GMSK modulated magnetic link. At step 88, the host and the accessory are now completely linked for data transfer. In one embodiment, such magnetic links can allow over 50 Kbps per line connected. Although the illustrations herein show 17 lines, embodiments herein are not limited thereto. For example, such an arrangement can have as many lines as found in RS232 connectors or almost any other type connector. To disengage the accessory connector from the radio, a software feature (or alternatively, a physical switch) on the host device can be used to deactivate the current supplying the electromagnetic power at step 89. With electromagnetic current eliminated at step 90, the accessory connector is now only attached via permanent magnets. In this condition, a user can easily pull the connector away from host phone device at step 91.

Note, the plurality of magnets 14 used for data can be magnetic micro-transformers as described in, *E. Martincic, E. Gigueras, E. Cabruja*, et al, *Magnetic micro-transformers realized with flip-chip process, Journal of Micromechanics and MicroEngineering, Institute of Physics Publishing,* 14 (2004), S55-S58. These micro-transformers can be found to be 4 pm for lower coils and 48 μm for the upper coils. In this paper, experiments were conducted at 1 MHz and 0.69 to 0.445V. At 10 MHz, resonance occurs. Similarly, it's well known in the literature that magnetic induction can be used for other purposes. Induction can be used for energy transfer such as in a contact less battery charging or for simpler and Induction-based data transfers at speeds up to 200 Kbps using current technology. A connector that incorporates the ability to transfer energy and data is not known.

By taking advantage of the possibility of small micrometric inductors, such as GMSK modulated magnetic fields, and standard magnetic principles a novel connector can be constructed as described in the various arrangements above.

In light of the foregoing description, it should be recognized that embodiments in accordance with the present invention can be realized in hardware, software, or a combination of hardware and software. A network or system according to the present invention can be realized in a centralized fashion in one computer system or processor, or in a distributed fashion where different elements are spread across several interconnected computer systems or processors (such as a microprocessor and a DSP). Any kind of computer system, or other apparatus adapted for carrying out the functions described herein, is suited. A typical combination of hardware and software could be a general purpose computer system with a computer program that, when being loaded and executed, controls the computer system such that it carries out the functions described herein.

In light of the foregoing description, it should also be recognized that embodiments in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. A connector, comprising:

a housing;

a plurality of magnets within the housing used for data transfer;

at least one alignment magnet within the housing used for alignment and polarity, at least one magnetic induction circuit coupled to at least one of the plurality of magnets; and an inductive coil operating at a lower frequency than the at least one magnetic induction circuit to enable contactless energy transfer from the connector to an energy storage device operatively coupled to an electronic product;

wherein the plurality of magnets or the at least one alignment magnet is further used for power transfer.

2. The connector of claim 1, wherein the plurality of magnets include a plurality of inductor elements or a plurality of micro-inductor elements.

3. The connector of claim 1, wherein the at least one magnetic induction circuit comprises a magnetic induction circuit using Gaussian Minimum Shift Keying modulation.

4. The connector of claim 1, wherein the plurality of magnets are completely covered by the housing to provide an environmentally sealed connector.

5. The connector of claim 1, wherein the plurality of magnets remains partially externally exposed while remaining within the housing.

6. The connector of claim 1, wherein the connector further uses a sensor for detecting a coupling of the at least one alignment magnet with a corresponding magnet in an electronic product that couples with the connector.

7. The connector of claim 6, wherein the connector further comprises a metal core attracted to an electromagnet activated by the coupling of the at least one alignment magnet with the corresponding magnet in the electronic product.

8. The connector of claim 1, wherein the at least one alignment magnet is a permanent magnet.

9. A magnetic connector system, comprising:

a connector having a housing;

a plurality of magnets within the housing used for data transfer;

at least one alignment magnet within the housing used for alignment and polarity, wherein the plurality of magnets or the at least one alignment magnet is further used for power transfer using at least one magnetic induction circuit coupled to at least one of the plurality of magnets; and wherein an inductive coil operating at a lower frequency than the at least one magnetic induction circuit enables contact less energy transfer from the connector to an energy storage device operatively coupled to an electronic product.

10. The magnetic connector system of claim 9, wherein the plurality of magnets comprises a plurality of inductor elements.

11. The magnetic connector system of claim 10, wherein the at least one magnetic induction circuit comprises a magnetic induction circuit using Gaussian Minimum Shift Keying modulation.

12. The magnetic connector system of claim 10, wherein the connector is an environmentally sealed connector and further comprises an inductive coil operating at a lower frequency than the at least one magnetic induction circuit to enable contact less energy transfer from the connector to an energy storage device operatively coupled to an electronic product.

13. The magnetic connector system of claim 9, wherein the plurality of magnets include a plurality of micro-metric inductor elements.

14. The magnetic connector system of claim 9, wherein the plurality of magnets are completely covered by the housing to provide an environmentally sealed connector.

15. The magnetic connector system of claim 9, wherein the plurality of magnets remains partially externally exposed while remaining within the housing enabling either a direct electronic coupling or a magnetic inductive coupling between the plurality of magnets and a corresponding plurality of magnets in an electronic product that mates with the connector.

16. The magnetic connector system of claim 9, wherein the connector further uses a sensor in an electronic product that mates with the connector for detecting a coupling of the at least one alignment magnet with a corresponding magnet in the electronic product.

17. The magnetic connector system of claim 9, wherein the system further comprises an electronic product having a port with a plurality of corresponding magnetic elements that communicate either inductively or electrically with the plurality of magnets in the connector.

18. An electronic product, comprising:

a data communication and power charging port within a housing;

a plurality of magnets within the housing used for data transfer;

at least one alignment magnet within the housing used for alignment and polarity;

at least one magnetic induction circuit coupled to at least one of the plurality of magnets; and an inductive coil operating at a lower frequency than the at least one magnetic induction circuit to enable contact less energy transfer from the connector to an energy storage device operatively coupled to an electronic product;

wherein the at least one alignment magnet is further used for power transfer.

* * * * *